US007104402B2

(12) United States Patent
Whalen et al.

(10) Patent No.: US 7,104,402 B2
(45) Date of Patent: Sep. 12, 2006

(54) CASE FOR SPORTING EQUIPMENT

(75) Inventors: John Whalen, Sheridan, IL (US); John J. Hagemann, Plano, IL (US)

(73) Assignee: Plano Molding Company, Plano, IL (US)

( * ) Notice: Subject to any disclaimer, the term of this patent is extended or adjusted under 35 U.S.C. 154(b) by 367 days.

(21) Appl. No.: 10/414,055

(22) Filed: Apr. 15, 2003

(65) Prior Publication Data

US 2004/0256258 A1 Dec. 23, 2004

(51) Int. Cl.
*B65D 69/00* (2006.01)

(52) U.S. Cl. ..... 206/579; 206/315.11; 220/759

(58) Field of Classification Search ..... 206/317, 206/579, 315.1, 315.11, 349, 560, 565; 220/752, 220/755, 759, 768–770; 24/525; 211/85.7; 124/11, 23.1; 248/674, 675, 309.1; 269/166, 269/167

See application file for complete search history.

(56) References Cited

U.S. PATENT DOCUMENTS

| | | | | | |
|---|---|---|---|---|---|
| 2,531,550 | A | * | 11/1950 | Bradley et al. | 206/317 |
| 3,088,583 | A | | 5/1963 | Holtz | |
| 3,337,028 | A | | 8/1967 | Glavan | |
| 3,351,270 | A | | 11/1967 | Hohnjec | |
| 3,421,682 | A | | 1/1969 | Eisenbach | |
| 3,669,336 | A | * | 6/1972 | Robinson | 206/317 |
| 3,983,996 | A | * | 10/1976 | Hendren, III | 206/564 |
| D246,138 | S | | 10/1977 | Christensen et al. | |
| 4,170,801 | A | * | 10/1979 | Ward | 206/315.11 |
| 4,613,041 | A | * | 9/1986 | Carlton | 206/373 |
| 4,854,476 | A | | 8/1989 | Serio, Jr. | |
| 5,042,676 | A | * | 8/1991 | Gohlke | 220/759 |
| 5,242,050 | A | | 9/1993 | Billings | |
| D343,057 | S | | 1/1994 | Dickinson | |
| D358,254 | S | | 5/1995 | VanSkiver | |
| 5,456,379 | A | | 10/1995 | Krupa et al. | |
| 5,640,944 | A | * | 6/1997 | Minneman | 206/315.11 |
| 5,771,536 | A | * | 6/1998 | Sieg et al. | 220/759 |
| 5,775,313 | A | | 7/1998 | Bresette et al. | |
| 5,803,069 | A | | 9/1998 | Schreiber | |
| 5,848,718 | A | | 12/1998 | Colwell | |
| 6,027,036 | A | * | 2/2000 | Taylor | 206/315.11 |
| 6,193,089 | B1 | | 2/2001 | Yu | |
| 6,789,670 | B1 | * | 9/2004 | Cooper et al. | 206/349 |

OTHER PUBLICATIONS

Doskocil Mfg. Co. 1995 Gun Guard Quality Sporting Cases Catalog, p. 13 (Archery Edition).
Woodstream (an EKCO Group Company) 1991 Hunting and Shooting Accessories Catalog (Inside cover—Field Locker), p. 2.
Kolpin Mfg., Inc. 1997 Hunting Products Catalog, p. 15 (Gator Hard-Sided Bow Cases).

* cited by examiner

*Primary Examiner*—Luan K. Bui
(74) *Attorney, Agent, or Firm*—Vedder, Price, Kaufman & Kammholz, P.C.

(57) ABSTRACT

A case for storage and transportation of sporting equipment including a case section defining an interior cavity. At least one clamp disposed within the interior cavity including a body portion and a jaw portion. The jaw portion is movable relative to the body portion to fasten and unfasten sporting equipment with respect to the case.

23 Claims, 6 Drawing Sheets

CASE FOR SPORTING EQUIPMENT

BACKGROUND OF THE INVENTION

The present invention relates generally to a case for sporting equipment, and more particularly, to a multi-part molded, protective case which is adapted for easy, low-cost mass production manufacture and which prevents damage to the equipment stored therein by secure mounting of the sporting equipment and distribution of loads and forces thereupon.

Transporting sporting equipment, such as the archery equipment, including, but not limited to, bows, arrows and auxiliary storage containers in this present embodiment, has always been a difficult undertaking. By their very nature, sporting equipment is often large and cumbersome. Many times, the equipment is also relatively delicate in comparison to its size, especially the archery equipment shown in this embodiment. In particular, modern archery bows have a complex physical structure in order to provide the sophisticated function now expected from hunters and marksman. While a bow maybe disassembled for transportation, it is considered a major disadvantage if so required. Accuracy of the sights on a bow is lost if the bow is disassembled. Consequently, the tedious process of readjusting the sights must be reinitiated after each disassembly.

Sporting equipment, especially the archery equipment, is also very delicate when subjected to forces different from those of ordinary operation. Slight or unseen damage to archery bows can result in catastrophic failure of the equipment, which could injure the user. Presently, arrow shafts are preferably made from very thin walled aluminum tubing or carbon fiber. Slight tweaks, curves or bends in the arrow shaft will cause the arrow to fly off course when in use or, in the case of carbon fiber, an off axis or lateral impact can destroy the arrow shaft. Consequently, it is advantageous to use a protective case which can prevent any damage to the equipment therein from forces and loads applied thereto.

Traditional protective enclosures for sporting equipment usually include: (1) fabric, soft-sided, padded cases; (2) rectangular suitcase-style cases and (3) molded clamshell-style cases. For many reasons, there are obvious disadvantages to the soft-sided cases. First, and foremost, there is the lack of protection afforded the equipment inside. These cases are useful only to the extent that all of the equipment maybe transported in one case. As a result, these cases have rather limited usefulness for serious archers, be they hunters or marksman, or those concerned about the condition of their equipment. Accordingly, these soft-sided protective enclosures are priced on the very low end of the scale. It will be understood that although the sides of the case are padded, the large side panels easily deform when subjected to external loads or forces can only protect the equipment from abrasion or minimum force impacts, such as setting the case down. Another disadvantage is that the equipment, archery bows in this embodiment, is only loosely retained within the case by hold down straps which are incapable of positively securing the archery bow to the flexible sidewall. Without a stiff exterior panel, the level of protection afforded this sporting equipment is only sufficient for the infrequent or occasional user.

The traditional suitcase design for archery equipment provides more protection for the contents. Commonly, the construction includes a pair of identical plastic shells having an extruded metal band affixed about the perimeter of each such shell and a metal piano-style hinge joining the two shells together. One disadvantage of this style of case is the considerable size which is a result of the odd shape of an archery bow. Because this suitcase style of case is available only in conventional rectangularly-shaped designs, there is a considerable amount of extra space that is not used which renders the case cumbersome and unwieldy. Another major disadvantage of the suitcase-style case is the planar, unsupported side panels which are substantially larger than the end, top and bottom panels. Again, the shape of an archery bow requires a case with large side panels relative to the ends, top and bottom. As a result, the sides of the case easily deform inward once subjected to an external load or force. The side panels of these suitcase-style cases are not designed to absorb or distribute significant impact forces and are known to fail in an attempt to do so. The perimeter edges are designed to carry all the loads imposed on the case; however, the metal bands are easily damaged and as such misalignment are common. As a result, known suitcase-style designs permit deformation of the side panels to the extent that the archery bow and/or arrows can be damaged.

Molded clamshell-style cases were designed to overcome the disadvantages of the above prior art sporting equipment cases. The most commercially successful molded archery case design is described in U.S. Pat. No. 6,390,294. The molded, clamshell-style case, as described therein, includes first and second case sections connected for movement between open and closed positions. Each of the first and second case sections include supports formed in the wall extending into the interior recess. Each of the first case section supports engages one of the second case section supports. The engaged support pairs are centrally located upon the first and second case sections such that when disposed in a closed position, a protective zone is defined about the central portion of the case.

While this molded, clamshell-style case is very effective in overcoming the disadvantages of the prior art, avid archery and marksman still find minor disadvantages with this design. In particular, the clamshell-style design is still somewhat cumbersome in that a very large footprint is necessary in order to open the case and access the contents therein. For example, when a marksman is at an archery range, the suitcase- or clamshell-style case must be set upon a table or on the ground so that one case section may be moved through at least 180° to a fully opened position in order to access the contents therein. The case must then be closed and oriented upright for temporary storage in the marksman's lane at the archery range. The suitcase- or clamshell-style case maybe left partially open, with one case section moved at least 90° relative to the other, while the marksman is in the lane at the archery range. However, such orientation of the case occupies considerable floor space in the lane and may compromise the marksman's stance. Available floor space in a lane at the shooting range is at a premium as archery range facilities need to have more lanes available for marksman rather than storage containers.

Therefore, there is a significant demand for a durable, protective case for safely transporting or storing sporting equipment, such as archery equipment, which provides the advantages of low-cost, high-strength, impact-resistance, low distribution, automatic alignment and multi-functional use which economizes footprint and space requirements while increasing functionality to the marksman.

BRIEF DESCRIPTION OF THE DRAWINGS

In the course of the following detailed description, reference will be made to the attached drawings, wherein like reference numerals identify like parts and in which.

DETAILED DESCRIPTION OF THE PREFERRED EMBODIMENTS

Figure 1:
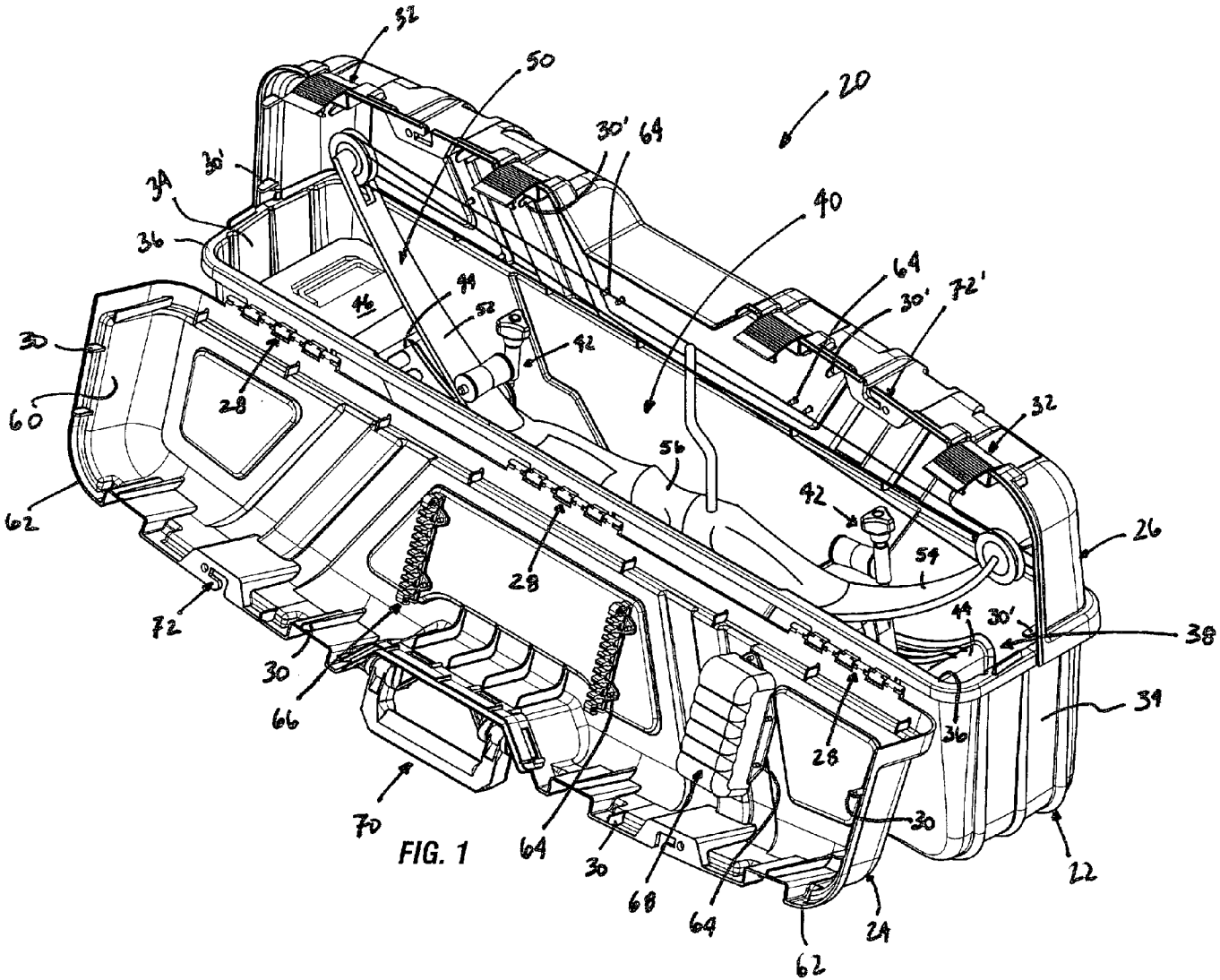
FIG. 1 is a perspective view of the case for sporting equipment constructed in accordance with the principals of the present invention, illustrating one second case section disposed in an open position.

The case of the present invention is primarily for use in storage and transportation of sporting equipment. In one principal aspect of the present invention, the case includes a case section defining an interior cavity and at least one clamp disposed within the interior cavity including a body portion and a jaw portion. The jaw portion is movable relative to the body portion to fasten and unfasten the sporting equipment to the case. In one embodiment, the body portion includes a base, a movable arm and a stop movably connected to the arm for adjusting the orientation of the jaw portion with respect to the body portion. In another embodiment, the jaw portion includes an axle movably connected to the body portion and a press movably connected to the axle. In yet another embodiment, the jaw portion includes an axle slideably and rotatively movable with respect to the arm. In still another embodiment, the body portion is repositionable within the interior cavity to accommodate differently dimensioned sporting equipment.

In another principal aspect of the present invention, the case for storage and transportation of an archery bow includes a first case section and at least one second case section. The first and second case sections are operatively connected to move between an open position and a closed position. The first and each second case section cooperatively define an interior cavity when disposed in the closed position. At least one clamp is disposed within the interior cavity including a body portion and a jaw portion. The jaw portion is movable along a first axis of the body portion to fasten the bow to the case and angularly with respect to the first axis of the body portion to unfasten the bow from the case. In one embodiment, the body portion includes a base, a movable arm and a stop movably connected to the arm for adjusting the orientation of the jaw portion with respect to the body portion. In another embodiment the jaw portion includes an axle movably connected to the body portion and a press movably connected to the axle. In yet another embodiment, the jaw portion includes an axle slideably and rotatively movable with respect to the arm. In still another embodiment, the body portion includes a bottom surface having at least one groove formed therein for engaging a guide disposed on a track formed in the first case section, such that the body portion is movable along the track to accommodate differently dimensioned archery bows.

In another principal aspect of the present invention, the case for storage and transportation of an archery bow having a pair of limbs interconnected by a riser includes a first case section including a wall having a rim defined at a free end thereof and defining an opening. A plurality of second case sections are connected to the first case section adjacent to the opening and the plurality of second case sections are movable between an open position and a closed position. The first case section and plurality of second case sections cooperatively define an interior cavity. A plurality of mounts are formed in the interior cavity and each is continuous with the wall and has an upper surface. A clamp, including a body portion and a jaw portion is disposed on the upper surface of each of the plurality of mounts. The jaw portion is movable along a first axis of the body portion to fasten one of the limbs in the clamp and angularly with respect to the first axis of the body portion to unfasten one of the limbs from the clamp. In one embodiment, the body portion includes a base, a movable arm and a stop movably connected to the arm for addressing the orientation of the jaw portion with respect to the body portion. In another embodiment, the jaw portion includes an axle movably connected to the body portion and a press movably connected to the axle. In yet another embodiment, the jaw portion includes an axle slideably and rotatively movable with respect to the arm. In still another embodiment, the body portion includes a bottom surface having a plurality of grooves formed therein for engaging at least of the plurality of guides formed on the upper surface of each of the plurality of mounts defining a track such that the body portion is laterally and longitudinally adjustable along the track to accommodate differently dimensioned archery bows.

In still another principal aspect of the present invention, a case for storage and transportation of sporting equipment includes a case section including a wall having a free edge and at least one integrally formed latching element adjacent to the free edge in a gripping zone. A handle assembly includes a base portion in the handle portion movable relative to the base portion. The base portion includes a pair of flanges defining a channel configured to receive the free edge. A recess is disposed in the channel for operative association with each at least one latching element such that the handle assembly snap-fits to the case section. In one embodiment, the base portion includes a central portion and opposed end portions disposed at an acute angle to the central portion.

In still yet another principal aspect of the present invention, a handle assembly for operative connection to a case includes a base portion and a handle portion movable relative to the base portion. The base portion includes a first flange and a second flange disposed parallel and spaced apart by a rib to define a first channel and a second channel on opposing sides of the rib. The first and second channels each include a central portion and opposed end portions. At least one latching recess is formed in the first flange and disposed in the first channel in at least one of the central and opposed end portions. Each end portion is disposed at an acute angle to the central portion. The first channel is adapted to connectably engage the case and the second channel is adapted to operatively engage the case.

In yet another principal aspect of the present invention, a clamp for fastening and unfastening sporting equipment to a case includes a body portion adapted to engage the case including a base, a movable arm and a stop movably connected to the arm. A jaw portion is movable relative to the body portion and includes an axle and a press movably connected to the axle. The stop adjusts the orientation of the jaw portion with respect to the body portion in order to fasten and unfasten sporting equipment to the case. In one embodiment, the stop threadably engages the arm. In another embodiment, the axle is slideably and rotatively movable with respect to the arm. In yet another embodiment, the body portion includes a bottom portion having at least one groove formed therein adapted to engage a guide disposed in the case to facilitate repositioning of the body portion.

FIG. 1 is a perspective view of the case for sporting equipment constructed in accordance with the principles of the present invention, illustrating one second case section disposed in an open position. The case 20 includes a first case section 22 and at least one second case section. In this embodiment, a pair of opposing second case sections 24, 26 are shown. It will be recognized by those of skill in the art that a plurality of second case sections may be used. Each of the second case sections 24, 26 are connected to the first case section 22 by a plurality of hinges 28 such that each of the second case sections 24, 26 are moveable between a closed position, as shown by second case section 26, and an open position, as shown by second case section 24. The hinges 28 are partly formed on the first case section 22 and partly on each of the respective second case sections 24, 26 and each part of the hinge is operatively connected to the other by a rod (not shown) so that each part may be moved relative to the other. Alignment devices 30, 30' (as will be discussed below) are provided on the first case section 22 and each of the second case sections 24, 26 in order to facilitate proper alignment of all the case sections 22, 24, 26 with respect to one another in a closed position. A plurality of latch arms 32 are removably connected to mounts (not shown) on either of the second case sections 24, 26 in this embodiment, to secure the case in the closed position. Further detailed description of the latch arms and complementary assembly is provided in U.S. Pat. No. 6,390,294 and U.S. patent application Ser. No. 10/120,914, both of which are hereby incorporated herein by this reference in their entireties.

The first case section 22 includes a wall 34 having a rim 36 defined at a free end thereof. The rim 36 extends about the extent of the free end to define an opening 38. Generally, the hinges 28 are disposed on an outer edge of the rim 36 adjacent the opening 38. The wall 34 of the first case section 22 defines an interior cavity 40 which is accessible through the opening 38. At least one clamp 42 is disposed within the interior cavity 40. Further details of the structure and function of the clamp 42 is discussed below with respect to FIGS. 2–5. At least one mount 44 is formed in the interior cavity 40 contiguous with the wall 34. Further details of the structural and functional aspects of the mounts 44 is discussed below with respect to FIGS. 2 and 3. The mounts 44 are disposed within the interior cavity 40 such that an area outside the mounts is configured to receive a storage container 46 which enhances the carrying capacity of the case 20.

The sporting equipment 50, in one embodiment, is configured as an archery bow and more specifically as a compound archery bow having a pair of limbs 52, 54 interconnected by a riser 56.

The second case sections 24, 26 are substantially identical except for the noted minor differences discussed below. Accordingly, the discussion of the second case sections 24, 26 will be generally equally applicable to both such second case sections 24, 26 and like referenced numerals will be applied to like corresponding structure on the second case sections 24, 26 wherein the structure on second case section 26 will be identified by a prime indication. Each second case section 24, 26 includes a wall 60, 60' having a rim 62, 62' defined at a free end thereof. As mentioned above, each second case section 24, 26 is connected to the first case section 22 by a hinge 28 adjacent the opening 38. When disposed in a closed position, a portion of rim 62 is contiguous with rim 36 and another portion of rim 62 is contiguous with rim 62'. Additionally, when disposed in the closed position, a portion of rim 62' is contiguous with rim 36 and another portion of rim 62' is contiguous with rim 62. Each of the second case sections 24, 26 includes alignment devices 30, 30'; however, the alignment devices 30' as disposed on second case section 26 are offset from the alignment devices 30 disposed on second case section 24 in order to provide engagement there between which thereby further strengthens the case 20. Each of the second case sections 24, 26, when disposed in the closed position, further define additional portions of the interior cavity 40 such that the first case section 22 and the second case sections 24, 26 cooperatively define an interior cavity 40.

A plurality of lugs 64, 64' are formed on the inner surface of the second case sections 24, 26 such that arrow holders 66 and a hood 68 may be connected thereto. In this embodiment, the arrow holders 66 and hood 68 are only connected to second case section 24. However, it is within the teachings of the present invention that additional arrow holders 66 and hood 68 could be attached only to the second case section 26 or additionally to the second case section, if so desired. The arrow holders 66 of the present invention have been described in more detail in U.S. Pat. No. 6,390,294 and U.S. patent application Ser. No. 10/120,914, both of which are hereby incorporated herein by this reference in there entireties. The hood 68 is a protective enclosure which shields the arrow points from damage and from damaging the bow 50.

Second case section 24 further includes a gripping zone which facilitates connection of a handle assembly 70 thereto as is described in more detail below with respect to FIGS. 6–9. Hold downs 72, 72' are provided on each second case section 24, 26 such that when the second case sections 24, 26 are disposed in the closed position the opposing hold downs 72, 72' are aligned to facilitate receipt of a strap for connecting the case 20 to another object, such as an all-terrain vehicle.

Each of the first and second case sections 22, 24, 26 are preferably made from polypropylene and may be also made from polyethelene. Generally, each of the first and second case sections 22, 24, 26 has a thickness in the range of 0.130 to 0.140 inches. The thickness dimension may be adjusted to any level as desired to meet predetermined strength levels. For example, depending on the amount of acceptable deflections the thickness value may be in the range of 0.383 inches. Further, each of the first and second case sections 22, 24, 26 is preferably formed by plastic injection molding and may also be formed by blow molding, rotational molding or any other suitable process for manufacturing such parts.

The case 20 of the present invention is particularly advantageous over the prior art because it has a very small footprint when disposed in the open position. This advantage is particularly useful for marksman at the archery range because the marksman has access to everything inside the case 20 and further, the bow 50 may be conveniently temporarily stored in the interior cavity 40 when the marksman retrieves his arrows from the target.

Figure 2:
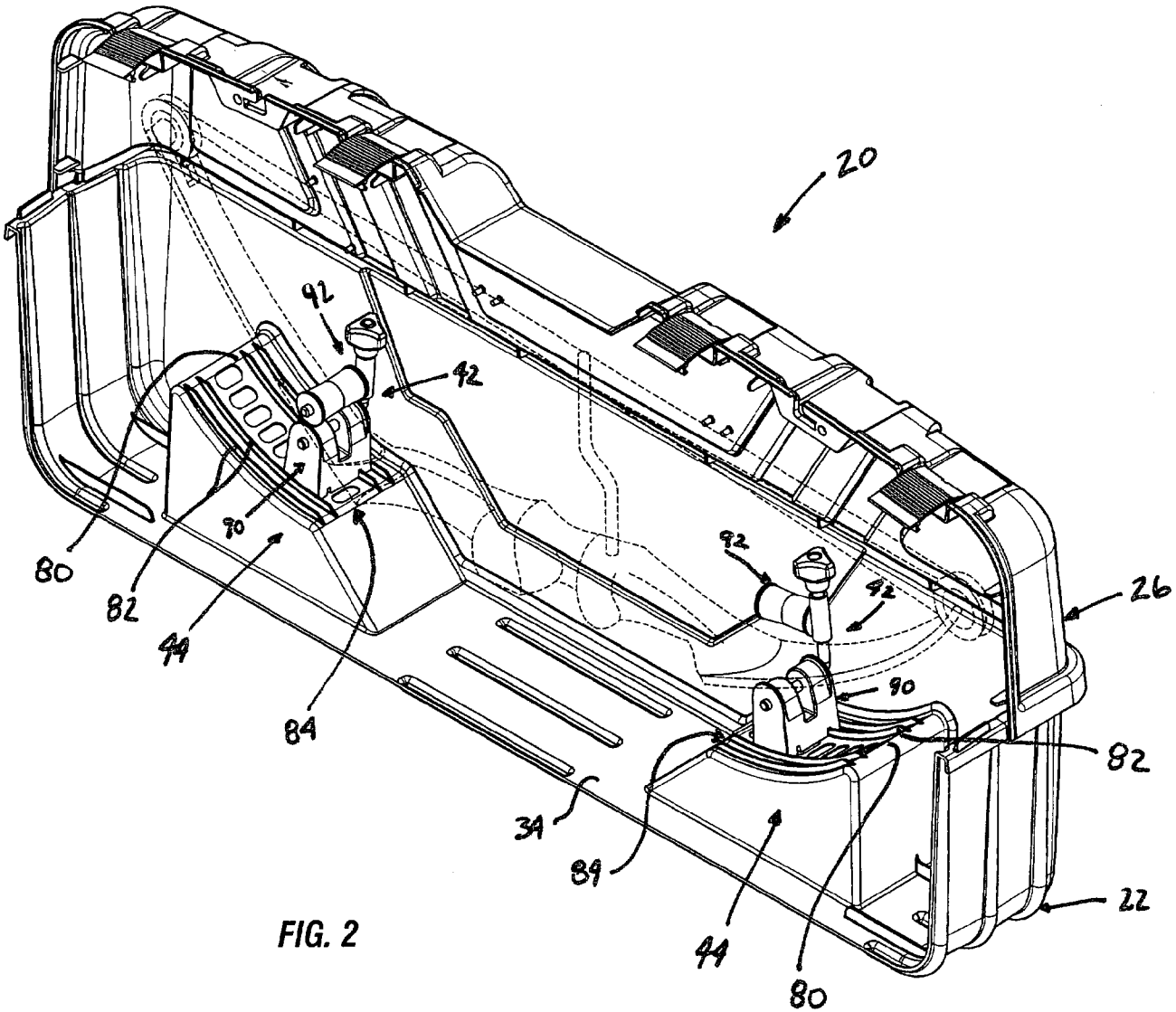
FIG. 2 is a partial cut-away perspective view of the case of FIG. 1 illustrating the interior cavity thereof.

FIG. 2 is a partial cutaway view of the case of FIG. 1 illustrating the interior cavity 40 of the case 20. Second case section 26 is connected to first case section 22 and is disposed in the closed position. A plurality of mounts 44 are formed in the wall 34 and disposed within the interior cavity 40. Each mount 44 is contiguous with the wall 34 and has an upper surface 80. A plurality of guides 82 are formed on the upper surface 80 of each of the mounts 44 to define a track 84. Preferably, the track is curvilinear. However, it is within the teachings of the present invention that the track 84 may take any shape as so desired. At least one knockout 86 is formed on the track in order to facilitate connection of the clamp 42 to the mount 44 at a desired position as is discussed below in more detail.

The clamp 42 includes a body portion 90 and a jaw portion 92. The jaw portion 92 is movable relative to the body portion 90 to fasten and unfasten the sporting equipment with respect to the case 20. The jaw portion 92 may be moved linearly toward and away from the body portion 90 and angularly with respect to various axes with respect to the body portion 90.

Figure 3:
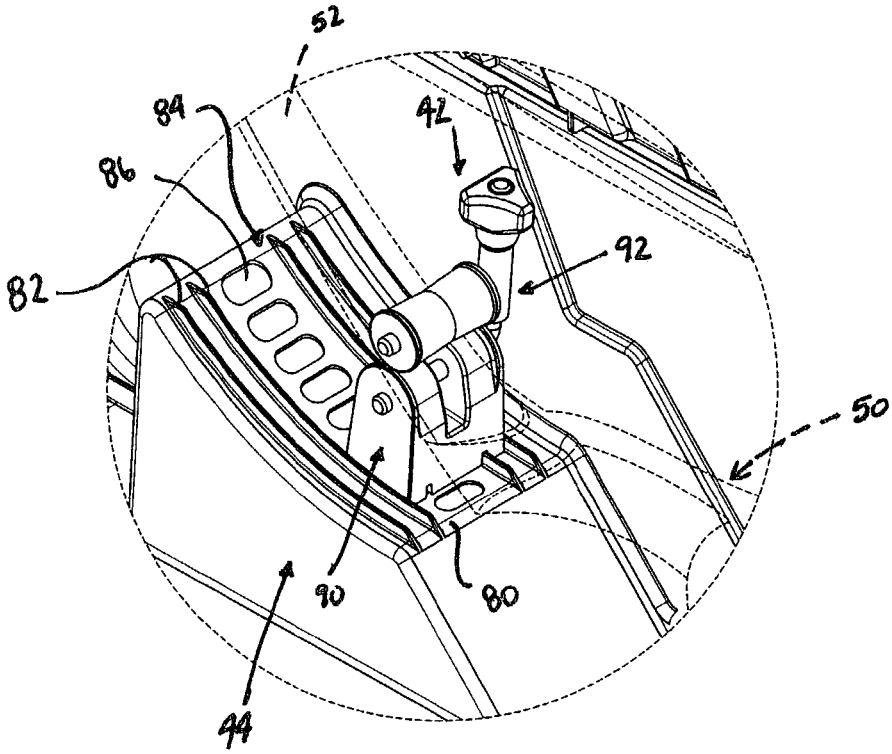
FIG. 3 is a detailed view of a portion of the case of FIG. 2 illustrating a clamp useful for securing sporting equipment to the case.

FIG. 3 is a detailed view of a portion of the case 20 of FIG. 2 illustrating the clamp 42 useful for securing sporting equipment to the case 20. The mount 44 has an upper surface 80 upon which a plurality of guides 82 are formed to define a track 84. A plurality of knockouts 86 are provided along the longitudinal length of the track 84. The guides 82 are laterally spaced across the track 84 to provide lateral adjustability for the clamp 42 in order to fit differently dimensioned sporting equipment. The clamp 42 includes a body portion 90 and a jaw portion 92 which operatively cooperate to fasten or unfasten sporting equipment, and more particularly in this embodiment, one of the limbs 52 of the bow 50 with respect to the clamp 42.

Figure 4:
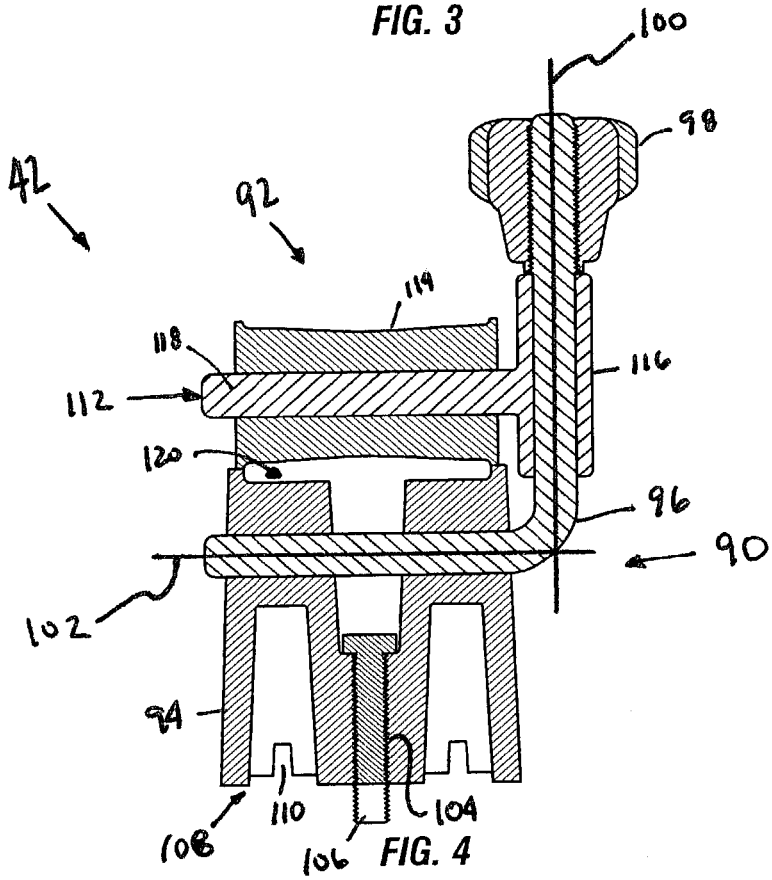
FIG. 4 is a cross-sectional view of the clamp illustrated in FIG. 3.

FIG. 4 is a cross-sectional view of the clamp 42 illustrated in FIG. 3. The clamp 42 includes a body portion 90 and jaw portion 92. The body portion 90 includes a base 94, a movable arm 96 and a stop 98. The stop 98 is movably connected to the arm 96 for adjusting the disposition or spacing of the jaw portion 92 with respect to the body portion 90. Preferably, the stop 98 threadably engages the arm 96 and is configured as a handle to facilitate hand tightening and loosening thereof. It is within the teachings of the present invention that the stop 98 may engage the arm 96 in any other suitable manner and accordingly configured to facilitate such engagement. Preferably, the movable arm 96 is friction fit to the base 94 such that movement of the arm 96 is permitted upon application of a small breakaway force. The arm 96 will then maintain its new position. It is within the teachings of the present invention that the arm 96 may also fit the base 94 more loosely than a friction fit and still perform its intended function. The movable arm 96 defines a first axis 100 and a second axis 102. The first axis 100 extends through that portion of the movable arm 96 which engages the stop 98. The second axis 102 extends through that portion of movable arm 96 which engages the base 94. The first and second axes 100, 102 are preferably normally oriented. However, it is within the teachings of the present invention that the first and second axes 100, 102 may also be obliquely disposed as desired.

The body portion 90 further includes a bore 104 extending there through which is configured to receive a threaded fastener 106 in order to facilitate connection of the clamp 42 to the track. As discussed above, the track includes a plurality of knockouts such that aligned registry of the bore 104 and a desired removed knockout facilitates securing the clamp 42 to the case.

A knockout is configured as a thinned portion of the wall 34 which may be cleanly removed therefrom upon application of sufficient force.

Upon alignment of the bore 104 and a selected knockout, a threaded fastener 106 may be inserted therethrough to engage a suitable complimentary threaded fastener part (not shown). Preferably, the bore 104 is not threaded. However, if so desired, the bore 104 may be configured with threads which would engage the threaded fastener 106.

The body portion 90 further includes a bottom surface 108 which has at least one groove 110 formed therein for engaging at least one of the plurality of guides formed on the upper surface of each of the plurality of mounts that define the track such that the body portion 90 is laterally and longitudinally adjustable along the track to accommodate differently dimensioned sporting equipment, particularly archery bows. It is within the teachings of the present invention that the orientation of the movable arm 96 with respect to the body portion 90 may be reversed from that as shown FIG. 4.

The jaw portion 92 includes an axle 112 and a press 114 which is movably connected to the axle 112. The axle 112 includes a base portion 116 and a finger portion 118. The base portion 116 is configured to engage the arm 96 such that the axle 112 is slideably and rotatively movable with respect to the arm 96. In particular, the jaw portion 92 is movable along the first axis 100 to fasten the sporting equipment, in this embodiment one of the limbs of the bow, in the clamp 42 and angularly about the first axis 100 to unfasten the sporting equipment, in this embodiment, one of the limbs of the bow, from the clamp 42. Movement of the stop 98 controls movement of the axle 112. The base portion 116, preferably has a loose friction fit with respect to the arm 96. However, it is within the teachings of the present invention that the base portion 116 may be fit to the arm 96 more loose than a friction fit. The finger portion 118 normally extends from the base portion 116. However, it is within the teachings of the present invention that the finger portion 118 may also extend obliquely from the base portion 116. The press 114 is loosely friction fit to the finger portion 118 of the axle 112 such that the press 114 will move with respect to the axle upon the application of appropriate force and does not require an element to retain the press 114 on the finger portion 118. However, it is within the teachings of the present invention that the press 114 may, be fit to the finger portion 118 more loose than a friction fit. The press 114 is preferably formed from any resilient material, such as, but not limited to, thermo-plastic rubber. However, it is within the teachings of the present invention that the press 114 may also be formed from any other suitable materials, such as, but not limited to rubber, plastic or other resilient material. It is within the teachings of the present invention that the press may be formed in any desired geometric shape. However, the generally cylindrical shape shown in the present embodiment is preferred.

In order to fasten sporting equipment to the case, each axle 112 is rotated with respect to the first axis 100 out of possible engagement with the sporting equipment as shown in FIG. 1, right hand side clamp. The sporting equipment is then fitted into position on a top surface 120 of the body portion. Each axle 112 is then rotated with respect to the first axis 100 into position squarely above the body portion 90, as shown in FIG. 1, left hand side clamp. The stop 98 is then moved with respect to the arm 96 to force the press 114 into engagement with the sporting equipment such that the sporting equipment is secured between the press 114 and the body portion 90. It will be recognized by those of skill in the art that during the process of fastening the sporting equipment to the case, the axle 112 may move angularly about the second axis 102. In order to remove the sporting equipment from the case, the stop 98 is moved with respect to the arm 96 such that the press 114 may be disengaged from the sporting equipment and rotated with respect to the first axis 100 to a position where the sporting equipment will not contact the jaw portion 92 during removal of the sporting equipment.

Figure 5:
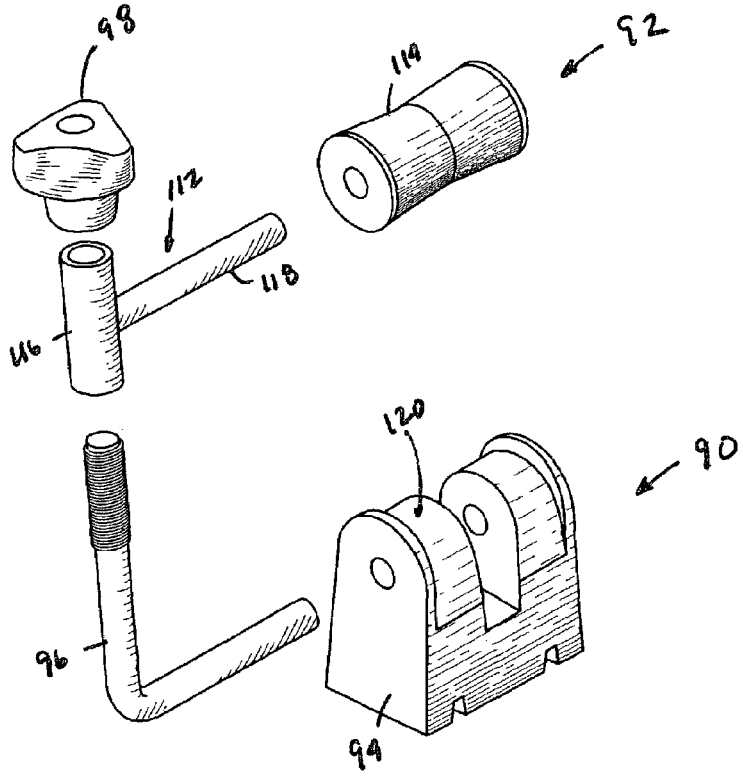
FIG. 5 is an exploded view of the clamp illustrated in FIG. 3.

FIG. 5 is an exploded view of the clamp 42 illustrated in FIG. 3. The body portion 90 includes the base 94, movable arm 96 and stop 98. The jaw portion 92 includes the axle 112 and press 114. The body portion 90 is adapted to engage the case such that it is repositionable within the interior cavity to accommodate differently dimensioned sporting equipment as described in detail above. The stop 98 threadably engages the arm 96 to contact the base portion 116 of the jaw portion 92 to cause the press 114 to engage the sporting equipment disposed between the press 114 and the base 94.

Figure 6:
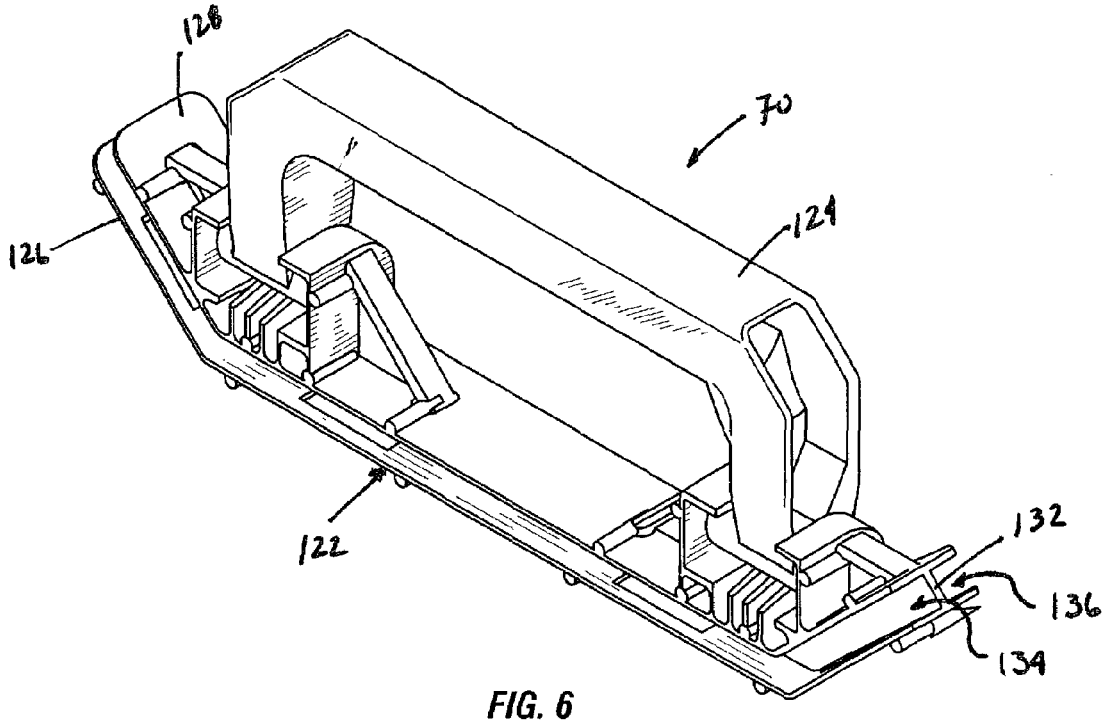
FIG. 6 is a detailed perspective view of a handle assembly illustrated in FIG. 1 constructed in accordance with the principals of the present invention.

FIG. 6 is a perspective view of the handle assembly 70 illustrated in FIG. 1 constructed in accordance with the principals of the present invention. The handle assembly 70 includes a base portion 122 and a handle portion 124 which is movable relative to the base portion 122. The base portion 122 includes a pair of flanges 126, 128 defining a channel therebetween which is configured to receive a free edge of the wall of a case section. The first and second flanges 126, 128 are generally disposed parallel and spaced apart by a rib 132 to define a first channel 134 and a second channel 136 on opposing sides of the rib 132.

Figure 7:
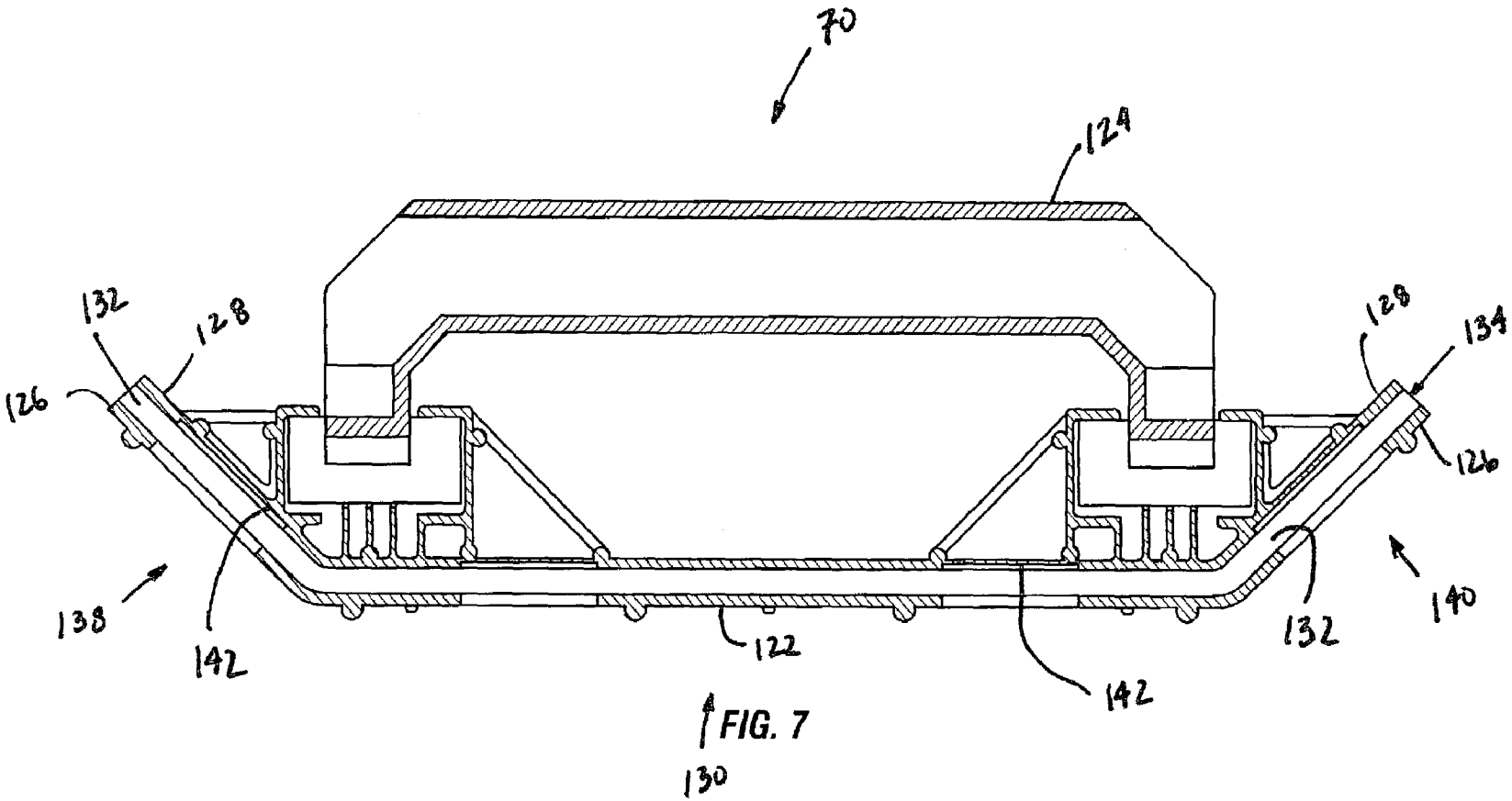
FIG. 7 is a cross-sectional view of the handle assembly illustrated in FIG. 6.

FIG. 7 is a cross-sectional view of the handle assembly 70 illustrated in FIG. 6. The handle portion 124 is movably connected to the base portion 122. The first flange 126 and the second flange 128 are generally disposed parallel and spaced apart by a rib 132. In this illustration, only the first channel 134 is shown. A second channel is disposed on the opposing side of the rib 132. The first and second channels each include a central portion 130 and opposed end portions 138, 140. At least one latching recess 142 is formed in one of the first and second flanges and disposed in the first channel 134 and at least one of the central 130 and opposed end portions 138, 140. In this embodiment, the recesses 142 are formed in the second flange 128. However, it is within the teachings of the present invention that the recesses 142 may be formed in the first flange 126 and/or the recesses 142 may be formed in the first or second flanges 126, 128 and disposed in the second channel, if so desired. In this embodiment, each end portion 138, 140 is disposed at an acute angle to the central portion 130. Preferably, the first channel 134 is configured to connectably engage the case such that the handle assembly snap-fits to the case section and the second channel is configured to operatively engage the case.

Figure 8:
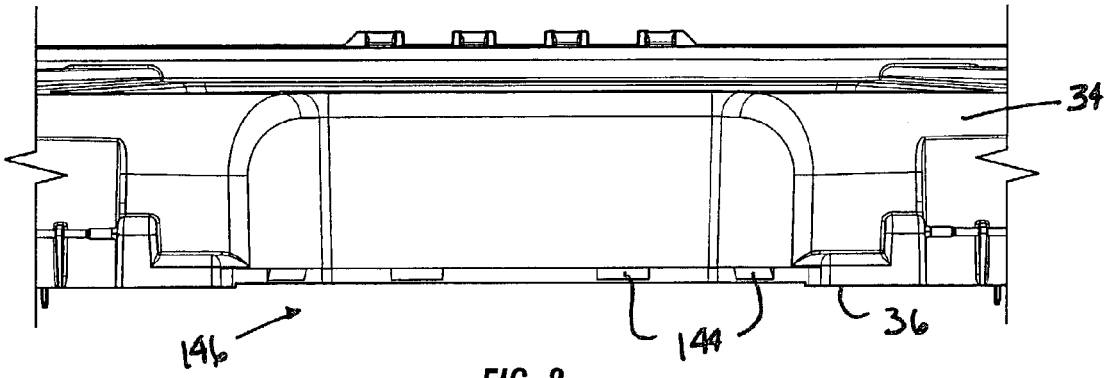
FIG. 8 is a detailed top view of a portion of one of the second case sections of FIG. 1 illustrating a gripping zone for engaging the handle assembly.

FIG. 8 is a detailed top view of a portion of one of the second case sections of FIG. 1 illustrating a gripping zone from engaging the handle assembly. The wall 34 includes a rim 36 defined at a free end thereof. A plurality of latching elements 144 are formed in a gripping zone 146 adjacent the rim 36 such that alignment of one of the channels of the handle assembly having recesses form therein with the gripping zone 146 enables the handle assembly to be snap fit to the case section. The latching elements 144 engage and are received within the recesses of the latching assembly to connect the handle assembly to the case section.

Figure 9:
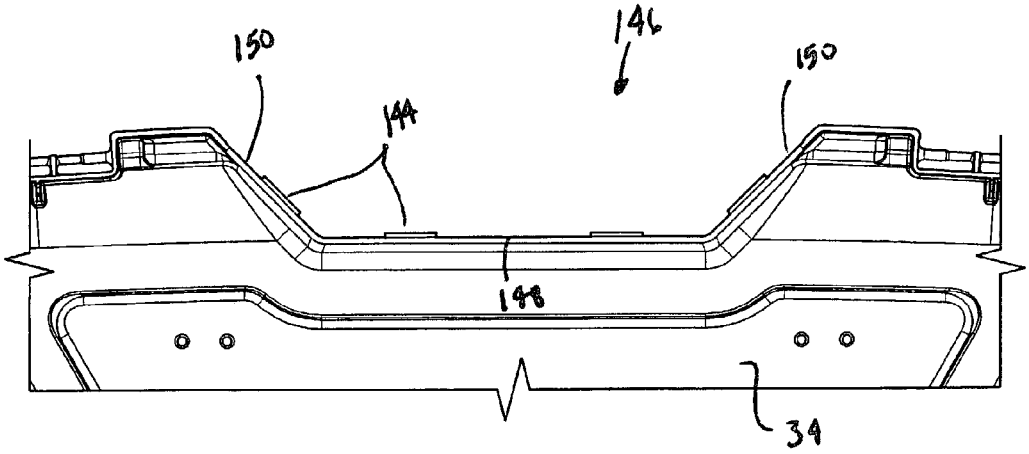
FIG. 9 is a detailed side view of the portion of one of the second case sections illustrated in FIG. 8.

FIG. 9 is a detailed side view of the portion of one of the second case sections illustrated in FIG. 8. The latching elements 144 are clearly shown as projections from the case section for engaging the recesses formed in the handle assembly. The rim 36 disposed in the gripping zone 146 has a central portion 148 and opposed end portions 150, 152. The configuration of the rim 36 in the gripping zone 146 mirrors the configuration of the channels of the handle assembly 70.

While the preferred embodiments of the invention have been shown and described, it will be apparent to those skilled in the art that changes and modifications may be made therein without departing from the spirit of the invention, the scope of which is defined by the appended claims.

What is claimed is:

1. A case for storage and transportation of sporting equipment, comprising:

a case section defining an interior cavity; and at least one clamp disposed within the interior cavity including a body portion and a jaw portion, wherein the body portion includes a base, moveable arm and a stop movable connected to the arm for adjusting orientation of the jaw portion with respect to the body portion, and the jaw portion is moveable relative to the body portion to fasten and unfasten the sporting equipment with respect to the case.

2. The case as recited in claim 1, wherein the jaw portion includes an axle movably connected to the body portion and a press movably connected to the axle.

3. The case as recited in claim 1, wherein the stop threadably engages the arm.

4. The case as recited in claim 1, wherein the jaw portion includes an axle slideably and rotatively movable with respect to the arm.

5. The case as recited in claim 1, wherein the body portion is repositionable within the interior cavity to accommodate differently dimensioned sporting equipment.

6. A case for storage and transportation of an archery bow, comprising:

a first case section and at least one second case section;

the first and each at least one second case sections operatively connected to move between an open position and a closed position;

the first and each at least one second case section cooperatively defining an interior cavity when disposed in the closed position;

at least one clamp disposed within the interior cavity including a body portion and a jaw portion; and the jaw portion movable along a first axis of the body portion to fasten the bow to the case and angularly with respect to the first axis of the body portion to unfasten the bow from the case, wherein the jaw portion includes an axle movably connected to the body portion and a press movably connected to the axle.

7. The case as recited in claim 6, wherein the body portion includes a base, a movable arm, and a stop movably connected to the arm for adjusting the orientation of the jaw portion with respect to the body portion.

8. The case as recited in claim 7, wherein the stop threadably engages the arm.

9. The case as recited in claim 7, wherein the jaw portion includes an axle slideably and rotatively movable with respect to the arm.

10. The case as recited in claim 6, wherein the body portion includes a bottom surface having at least one groove formed therein for engaging a guide disposed on a track formed in the first case section such that the body portion is movable along the track to accommodate differently dimensioned archery bows.

11. The case as recited in claim 10, wherein the track is curvilinear.

12. The case as recited in claim 10, wherein the track includes at least one knockout such that aligned registry with a bore through the body portion facilitates securing the body portion to the case.

13. The case as recited in claim 12, wherein a threaded fastener engages the bore and selected at least one knockout to facilitate securing the body portion to the case.

14. A case for storage and transportation of an archery bow having a pair of limbs interconnected by a riser, comprising:

a first case section including a wall having a rim defined at a free end thereof and defining an opening, a plurality of second case sections connected to the first case section adjacent the opening, the plurality of second case sections movable between an open position and a closed position;

the first case section and plurality of second case sections cooperatively defining an interior cavity;

a plurality of mounts formed in the interior cavity, each contiguous with the wall and having an upper surface;

a clamp, including a body portion and a jaw portion, disposed on the upper surface of each of the plurality of mounts; and the jaw portion movable along a first axis of the body portion to fasten one of the limbs in the clamp and angularly with respect to the first axis of the body portion to unfasten one of the limbs from the clamp, wherein the body portion includes a bottom surface having a plurality of grooves formed therein for engaging at least one of a plurality of guides formed on the upper surface of each of the plurality of mounts defining a track such that the body portion is laterally and longitudinally adjustable alone the track to accommodate differently dimensioned archery bows.

15. The case as recited in claim 14, wherein the body portion includes a base, a movable arm, and a stop movably connected to the arm for adjusting the orientation of the jaw portion with respect to the body portion.

16. The case as recited in claim 14, wherein the jaw portion includes an axle movably connected to the body portion and a press movably connected to the axle.

17. The case as recited in claim 15, wherein the stop threadably engages the arm.

18. The case as recited in claim 14, wherein the jaw portion includes an axle slideably and rotatively movable with respect to the arm.

19. The case as recited in claim 14, wherein the track is curvilinear.

20. The case as recited in claim 14, wherein the track includes at least one knockout such that aligned registry with a bore through the body portion facilitates securing the clamp to the case.

21. The case as recited in claim 20, wherein a threaded fastener engages the bore and a selected at least one knockout to facilitate securing the clamp to the case.

22. A case for storage and transportation of sporting equipment, comprising:

a case section including a wall having a free edge and at least one integrally formed latching element adjacent the free edge in a gripping zone; and a handle assembly including a base portion and a handle portion movable relative to the base portion;

the base portion including a first flange and a second flange disposed parallel and spaced apart by a rib defining a first channel and a second channel on opposing sides of the rib; the first and second channels each including a central portion and opposed end portions and configured to receive the free edge; and at least one latching recess formed in one of the first and second flanges and disposed in the first channel in at least one of the central and opposed end portions for operative association with each at least one integrally formed latching element, wherein the handle assembly snap-fits to the case section.

23. The case as recited in claim 22, wherein the base portion includes a central portion and opposed end portions disposed at an acute angle to the central portion.

* * * * *